US010011034B2

(12) United States Patent
Watanabe et al.

(10) Patent No.: US 10,011,034 B2
(45) Date of Patent: Jul. 3, 2018

(54) CUTTING PLOTTER

(71) Applicant: Graphtec Corporation, a corporation duly organized and existing under the laws of Japan, Kanagawa (JP)

(72) Inventors: Kazuhiro Watanabe, Kanagawa (JP); Ryoichi Oka, Kanagawa (JP)

(73) Assignee: Graphtec Corporation, Kanagawa (JP)

( * ) Notice: Subject to any disclaimer, the term of this patent is extended or adjusted under 35 U.S.C. 154(b) by 26 days.

(21) Appl. No.: 14/747,206

(22) Filed: Jun. 23, 2015

(65) Prior Publication Data

US 2016/0001458 A1 Jan. 7, 2016

(30) Foreign Application Priority Data

Jul. 2, 2014 (JP) ..... 2014-136592

(51) Int. Cl.
*B26F 1/38* (2006.01)
*B26D 7/02* (2006.01)
(Continued)

(52) U.S. Cl.
CPC ..... *B26F 1/3813* (2013.01); *B26D 7/015* (2013.01); *B26D 7/025* (2013.01); *B65H 5/068* (2013.01);
(Continued)

(58) Field of Classification Search
CPC ..... B26D 2007/2678; B65H 2404/112; B65H 2404/11221; B65H 2404/12;
(Continued)

(56) References Cited

U.S. PATENT DOCUMENTS 6,299,367 B1 * 10/2001 Kawakami ..... B41J 13/02 267/180
2005/0195259 A1 * 9/2005 Tanahashi ..... B41J 13/076 347/101
(Continued)

FOREIGN PATENT DOCUMENTS

EP 1557246 A2 7/2005
JP H08-072489 3/1996
(Continued)

OTHER PUBLICATIONS

Extended European Search Report, Application No. 15173837, dated Jan. 12, 2015, 6 pages.
(Continued)

*Primary Examiner* — Stephen Choi
*Assistant Examiner* — Evan MacFarlane
(74) *Attorney, Agent, or Firm* — Meyertons, Hood, Kivlin, Kowert & Goetzel, P.C.; Mark R. DeLuca

(57) ABSTRACT

A cutting plotter includes a driving roller, a rotating shaft, pinch rollers, a cutter, and a press roller. The driving roller extends in a direction of a first axis and rotates around the first axis. The rotating shaft extends in a direction of a second axis parallel to the first axis, and is configured to be rotatable around the second axis. A passage through which a cutting target passes is formed between the driving roller and the rotating shaft. The pinch rollers are provided on the rotating shaft. The cutter is selectively pressed to the cutting target. The press roller is provided on the rotating shaft between the pinch rollers, and presses the cutting target against the driving roller. The press roller is formed by a coil spring into which the rotating shaft is inserted.

3 Claims, 3 Drawing Sheets

(51) Int. Cl.

| | |
|---|---|
| ***B65H 5/06*** | (2006.01) |
| ***B26D 7/01*** | (2006.01) |
| *B26D 7/26* | (2006.01) |
| *B26D 7/00* | (2006.01) |

(52) U.S. Cl.
CPC ..... *B26D 2007/0087* (2013.01); *B26D 2007/2678* (2013.01); *B65H 2404/112* (2013.01); *B65H 2404/12* (2013.01); *Y10T 83/6636* (2015.04)

(58) Field of Classification Search
CPC .... B65H 2404/121; B65H 27/00; B65H 5/06; B65H 5/066; B65H 5/068; B65H 29/06; B65H 29/125; B65H 29/20; B65H 23/025; B65H 23/051; B65H 23/0255; B65H 23/0256; B65H 2404/10; B65H 2404/1121; B65H 2404/115; B65H 3/0638; F16C 1/02; F16C 1/06; Y10T 83/741; Y10T 83/743; Y10T 83/6636; Y10T 83/6643
USPC ..... 271/272, 314; 492/28, 30, 42
See application file for complete search history.

(56) References Cited

U.S. PATENT DOCUMENTS

| | | | | |
|---|---|---|---|---|
| 2011/0280999 | A1* | 11/2011 | Crystal ..... | A21C 15/002 426/231 |
| 2013/0008292 | A1 | 1/2013 | Kawaguchi et al. | |

FOREIGN PATENT DOCUMENTS

| | | |
|---|---|---|
| JP | 2003-205688 | 7/2003 |
| JP | 2005-205539 | 8/2005 |
| JP | 2012-171036 | 9/2012 |

OTHER PUBLICATIONS

Office Action issued for Japanese Patent Application No. 2014-136592 dated May 8, 2018.

* cited by examiner

CUTTING PLOTTER

BACKGROUND OF THE INVENTION

The present invention relates to a cutting plotter for cutting a sheet-like cutting target.

A cutting plotter for cutting a sheet-like cutting target by moving the cutting target and a cutter is called a grit rolling type cutting plotter. As disclosed in Japanese Patent Laid-Open No. 2003-305688 (literature 1) and Japanese Patent Laid-Open No. 2005-205539 (literature 2), a cutting plotter of this kind includes a pair of rollers for clamping a cutting target. The pair of rollers include a driving roller which is rotated by a driving device, and pinch rollers for clamping a cutting target by cooperating with the driving roller.

The driving roller rotates forward or backward when driven by the driving device. For example, a cutting target moves forward when the driving roller rotates forward, and moves backward when the driving roller rotates backward. The cutter moves in a vertical direction perpendicular to the major surface of the cutting target, and in a horizontal direction perpendicular to a forward-backward direction as the moving direction of the cutting target. The cutter sticks in the cutting target when moved downward and pressed to the cutting target. The cutting target is cut into a predetermined shape by moving the cutter in the horizontal direction and moving the cutting target in the back-and-forth direction while the cutter is stuck in the cutting target.

The above-described pinch rollers are arranged in positions corresponding to at least the two end portions of the cutting target. A press roller for pressing a middle portion of the cutting target is formed between the pinch rollers. The middle portion of the cutting target is pressed mainly because of the following two reasons. The first reason is to place the cutting target along the driving roller so that the cutter can correctly cut the cutting target in a cutting process. The second reason is to prevent the cutting target from being pulled and lifted by the cutter when the cutter rises after cutting. The press roller is formed by rubber.

As disclosed in Japanese Patent Laid-Open No. 08-072489 (literature 3), a large-sized cutting plotter sometimes includes a pressing mechanism for supporting the press roller. This pressing mechanism includes a swing arm having a swing end portion to which the press roller is rotatably attached, and a spring member for biasing this swing arm in a direction in which the press roller is pressed against the cutting target.

The cutting plotter including the rubber press roller poses a problem when cutting a relatively thick object as the cutting target. Examples of the relatively thick cutting target are a flute material and embossed sheet. When a thick cutting target like this is passed between the press roller and driving roller, the press roller is strongly pressed against the cutting target, and a recessed groove is formed on the cutting target. When the press roller is formed by black rubber, a black linear mark remains on the surface of the cutting target against which the press roller is pressed.

This inconvenience can be eliminated to some extent by adopting the arrangement in which the press roller is supported by the swing arm and pressed against the cutting target by the spring force of the spring member. However, the manufacturing cost increases if this arrangement using the swing arm is adopted.

SUMMARY OF THE INVENTION

It is an object of the present invention to provide a cutting plotter capable of preventing lifting of a cutting target by using a simple arrangement, without unnecessarily denting or contaminating the surface of the cutting target.

According to an aspect of the present invention, there is provided a cutting plotter comprising a driving roller extending in a direction of a first axis and configured to rotate around the first axis by a driving device, a rotating shaft extending in a direction of a second axis parallel to the first axis, and configured to be rotatable around the second axis, a passage through which a cutting target passes being formed between the driving roller and the rotating shaft, a plurality of pinch rollers provided on the rotating shaft, at least two end portions of the cutting target being clamped by the driving roller and the plurality of pinch rollers, a cutter to be selectively pressed to the cutting target, a moving member to which the cutter is attached, and which moves in a direction parallel to the first axis, and a press roller provided on the rotating shaft between the plurality of pinch rollers, and configured to press the cutting target against the driving roller, the press roller being formed by a coil spring into which the rotating shaft is inserted.

DESCRIPTION OF THE PREFERRED EMBODIMENT

A cutting plotter as an embodiment of the present invention will be explained in detail below with reference to FIGS. 1 to 4.

Figure 1:
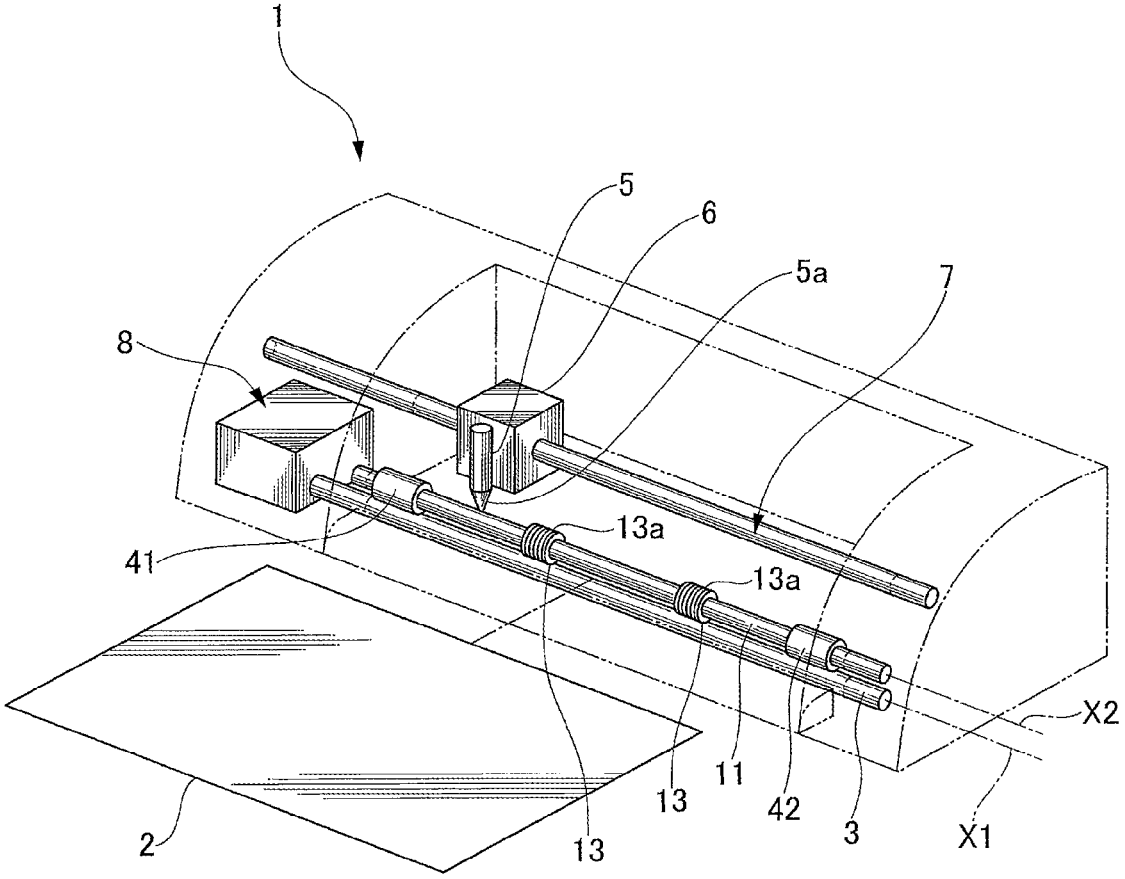
FIG. 1 is a perspective view showing the structure of a cutting plotter as an embodiment of the present invention.
Figure 2A:
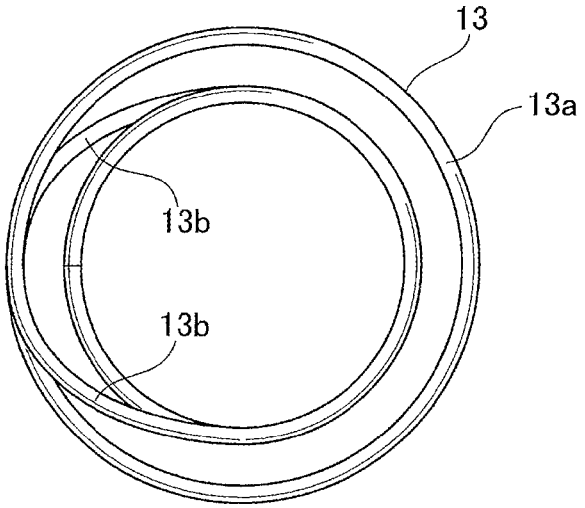
FIG. 2A is a front view of a press roller.
Figure 2B:
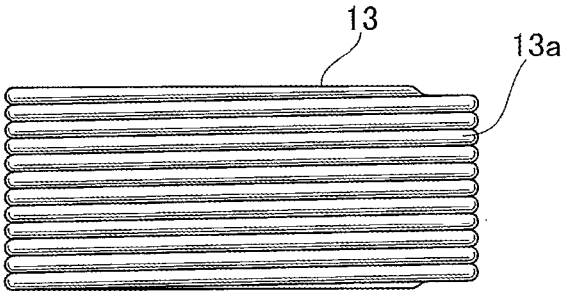
FIG. 2B is a side view of the press roller.
Figure 2C:
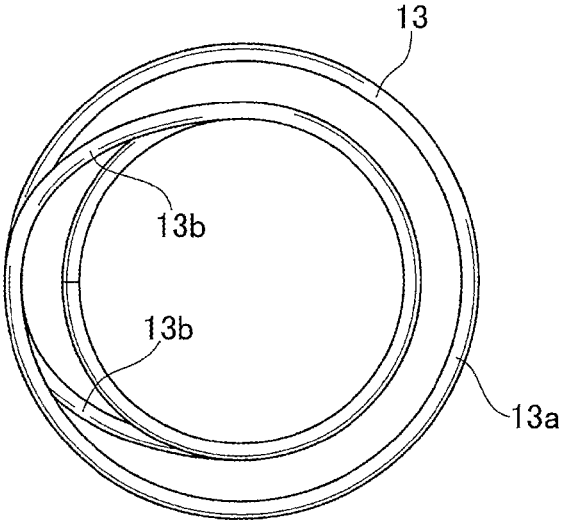
FIG. 2C is a back view of the press roller.
Figure 2D:
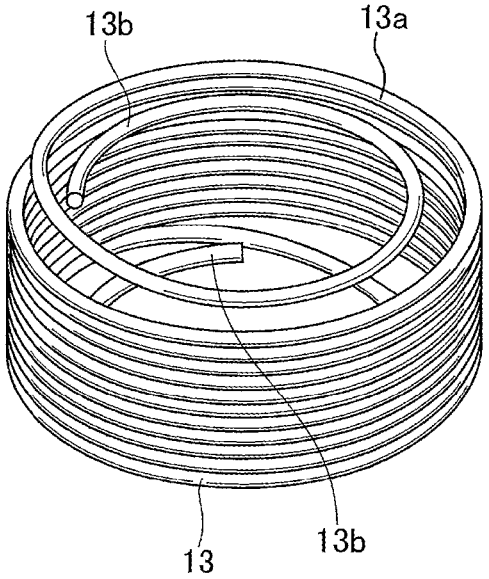
FIG. 2D is a perspective view of the press roller.

A cutting plotter 1 shown in FIG. 1 is an apparatus for cutting out a figure or character from a sheet-like cutting target 2. Examples of the cutting target 2 are a paper sheet, film, cutting film, flute material, and embossed sheet. An operation of cutting out a figure or character from the cutting target 2 is performed in a state in which the cutting target 2 is clamped between a driving roller 3 extending in a direction parallel to the major surface (upper surface) of the cutting target 2, and pinch rollers 41 and 42 positioned above and close to the driving roller 3, and a cutting pen (cutter) 5 is stuck in the cutting target 2 from above.

The cutting pen 5 is attached to a pen block 6 via a linear actuator (not shown) so as to be vertically movable. When the cutting pen 5 is driven and moved down by the linear actuator, a blade 5*a* formed at the lower end of the cutting pen 5 is urged against and stuck in the cutting target 2. That is, the cutting pen 5 is selectively pressed to the cutting target 2 when moved vertically.

The pen block 6 is supported by a moving device 7, and moves in a direction parallel to an axis X1 of the driving roller 3 when driven by the moving device 7. Accordingly, the pen block 6 functions as a moving member. The moving direction of the pen block 6 will be called a horizontal direction hereinafter.

The driving roller 3 has an elongated columnar shape extending in the direction of the first axis X1 from one side portion to the other of the cutting plotter 1. A driving device 8 including a driving motor (not shown) is connected to one end portion of the driving roller 3. The driving roller 3 rotates around the first axis X1 when driven by the driving device 8.

The pinch rollers 41 and 42 are attached to a rotating shaft 11 positioned above and close to the driving roller 3, and rotate together with the rotating shaft 11. The rotating shaft 11 extends in the direction of a second axis X2 parallel to the first axis X1, and can rotate around the second axis X2. That is, the rotating shaft 11 is parallel to the driving roller 3, and a passage 12 (see FIG. 3) through which the cutting target 2 passes is formed between the rotating shaft 11 and driving roller 3. In this embodiment, the two pinch rollers 41 and 42 are formed at the two end portions of the rotating shaft 11. The pinch rollers 41 and 42 are arranged in positions where the driving roller 3 and pinch rollers 41 and 42 can clamp the two end portions of the cutting target 2.

In a state in which the cutting target 2 is clamped between the driving roller 3 and pinch rollers 41 and 42, the cutting target 2 moves forward when the driving roller 3 rotates in one direction, and moves backward when the driving roller 3 rotates in the opposite direction. An operation of cutting out a figure or character from the cutting target 2 is performed by moving the cutting pen 5 in the horizontal direction and moving the cutting target 2 forward or backward, while the cutting pen 5 is stuck in the cutting target 2.

Press rollers 13 for pressing the cutting target 2 against the driving roller 3 are formed on the rotating shaft 11 between the pair of pinch rollers 41 and 42. Each press roller 13 is a coil spring wound around the rotating shaft 11. In this embodiment, the press roller 13 is formed by a tension coil spring into which the rotating shaft 11 is inserted.

As shown in FIGS. 2A to 2D, the tension coil spring includes a cylindrical wound portion 13*a* formed by helically winding a spring material, and helical portions 13*b* extending inward in the radial direction from the two ends of the wound portion 13*a*. The wound portion 13*a* is formed by winding the spring material a plurality of times. The helical portions 13*b* form the two end portions of the press roller 13, and are supported by the rotating shaft 11.

Figure 3:
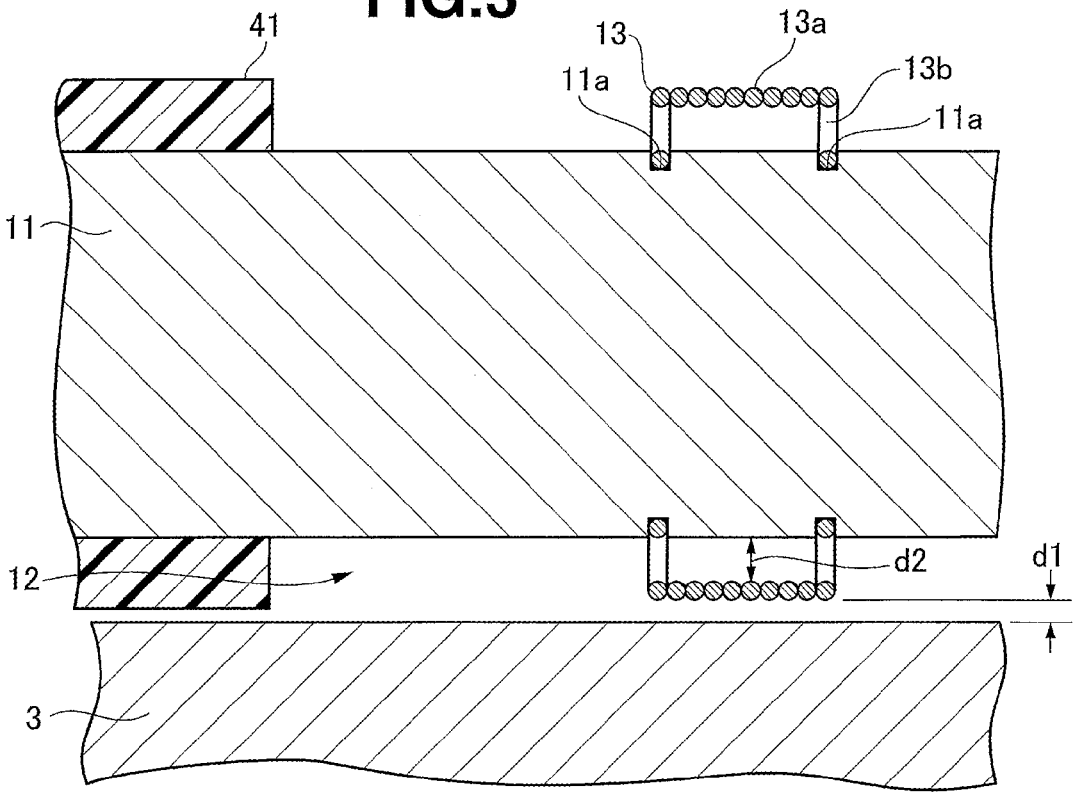
FIG. 3 is a sectional view of the main parts of the cutting plotter shown in FIG. 1 in an enlarged scale, showing a state in which no cutting target is loaded.
Figure 4:
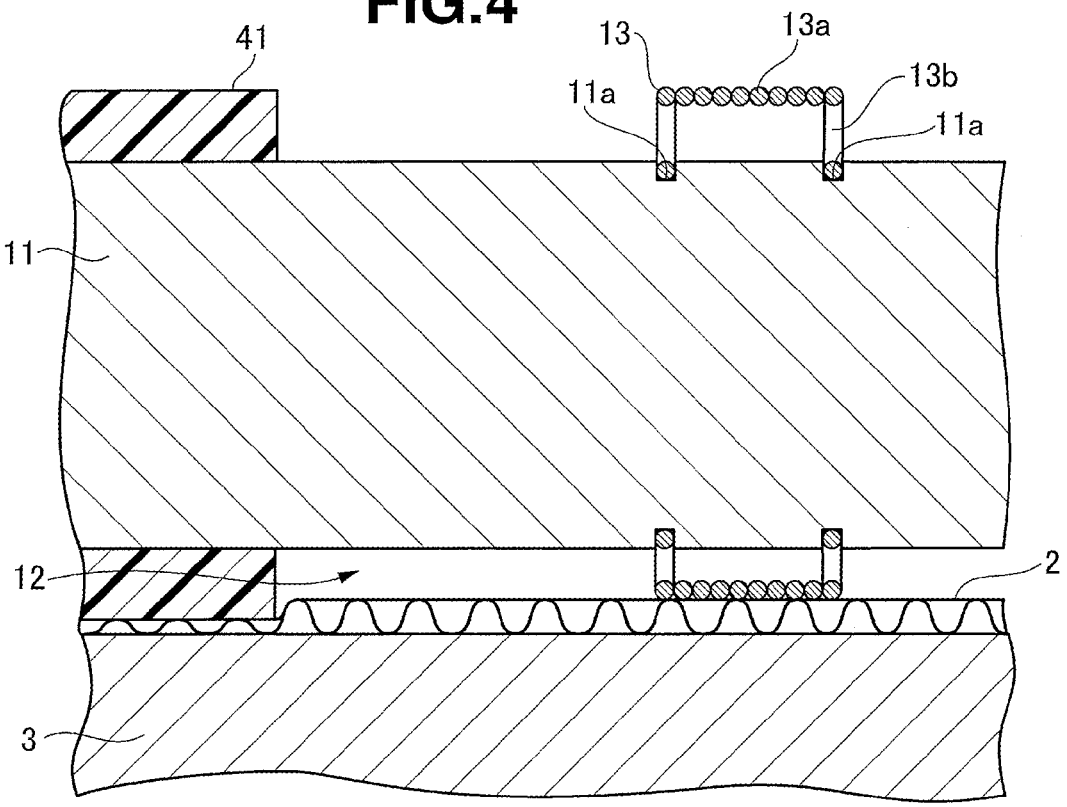
FIG. 4 is a sectional view of the main parts of the cutting plotter shown in FIG. 1 in an enlarged scale, showing a state in which a cutting target is loaded.

As shown in FIG. 3, the press roller 13 is formed to have a size which forms a gap d1 between the wound portion 13*a* and driving roller 3 in a natural state. The gap d1 is smaller than the thickness of a relatively thin cutting target 2. As shown in FIG. 3, the inner diameter of the wound portion 13*a* is larger than the outer diameter of the rotating shaft 11 by a gap d2 in a natural state. This forms the gap d2 between the rotating shaft 11 and wound portion 13*a*. As shown in FIG. 4, the gap d2 has a size by which the wound portion 13*a* does not touch the rotating shaft 11 even when using a relatively thick cutting target 2 such as a flute material.

The helical portion 13*b* of the press roller 13 is formed into a helical shape which gradually decreases the inner diameter toward the distal end. A distal end portion having the smallest inner diameter of the helical portion 13*b* is fixed to the rotating shaft 11. As shown in FIG. 3, this distal end portion is inserted into an annular groove 11*a* formed in the rotating shaft 11, and fixed so as not to be removable from the rotating shaft 11 by a fixing structure (not shown). The distal end portion of the press roller 13 can be fixed to the rotating shaft 11 by pasting using an adhesive tape, adhesion using an adhesive, or welding.

In the cutting plotter 1 including the press roller 13 formed by a tension coil spring, when a relatively thick cutting target 2 is passed between the press roller 13 and driving roller 3, as shown in FIG. 4, the press roller 13 comes in contact with the surface of the cutting target 2 and bends. That is, the wound portion 13*a* of the press roller 13 comes in contact with the surface of the cutting target 2, the helical portion 13*b* elastically deforms such that the diameter of the helical portion 13*b* decreases, and the wound portion 13*a* is displaced in a direction away from the driving roller 3. Therefore, the press roller 13 does not apply any excess force to the surface of the cutting target 2. Consequently, the cutting target 2 is pressed, with no deformation, against the driving roller 3 by the spring force of the press roller 13 formed by a tension coil spring. Accordingly, this embodiment can prevent lifting of the cutting target 2 by using a simple arrangement, and does not unnecessarily dent or contaminate the surface of the cutting target 2.

In this embodiment, the press roller 13 is formed by a tension coil spring. The helical portions 13*b* as the two end portions of the tension coil spring are supported by the rotating shaft 11, and the gap d2 is formed between the rotating shaft 11 and wound portion 13*a*. In this embodiment, the outer circumferential surface of the press roller 13 is a cylindrical surface, so the force with which the press roller 13 presses the cutting target 2 can be dispersed in the wide range of the cutting target 2. Accordingly, a press mark formed when the press roller 13 presses the cutting target 2 more hardly remains.

In this embodiment, the helical portions 13*b* as the two end portions of the tension coil spring are each formed into a shape which gradually decreases the inner diameter toward the distal end, and the distal end portion in which the inner diameter is smallest is fixed to the rotating shaft 11. Consequently, a change in pressing force when the press roller 13 rotates while pressing the cutting target 2 can be decreased as much as possible. In this embodiment, therefore, the force which the cutting target 2 receives from the press roller 13 when the cutting target 2 moves forward or backward becomes almost constant, and this increases the capability of preventing lifting of the cutting target 2. This makes it possible to cut the cutting target 2 at a higher accuracy.

In the above-described embodiment, an example in which the press roller 13 is formed by a tension coil spring is disclosed. However, the present invention is not limited to this example. That is, the press roller 13 can be any roller as long as the roller includes the wound portion 13*a* wound around the rotating shaft 11. For example, the press roller 13 can also be formed by using a compression coil spring, helical torsion coil spring, spiral spring, or volute spring.

Although an example in which the rotating shaft 11 includes the two pinch rollers 41 and 42 is disclosed, the number of pinch rollers may also be three or more. Furthermore, at least the two end portions of the cutting target 2 need only be clamped by the driving roller 3 and a plurality of pinch rollers.

What is claimed is:

1. A cutting plotter system comprising:

a driving roller extending in a direction of a first axis and configured to rotate around the first axis by a driving motor;

a rotating shaft extending in a direction of a second axis parallel to the first axis, and configured to be rotatable around the second axis;

a cutting target passing through a passage formed between the driving roller and the rotating shaft;

a plurality of pinch rollers provided on the rotating shaft, wherein the driving roller and the plurality of pinch rollers are configured to come in contact, respectively, with a first surface and a second surface opposite to the first surface of the cutting target and to clamp at least two end portions of the cutting target and move the clamped cutting target forward or backward;

a cutter to be selectively pressed to the cutting target;

a support coupling the cutter to a support rod, wherein, during use, the support can be moved along the support rod in a direction parallel to the first axis; and a press roller provided on the rotating shaft between the plurality of pinch rollers, and configured to press the cutting target against the driving roller to thereby prevent lifting of the cutting target, wherein the press roller is formed by a coil spring into which the rotating shaft is inserted, the coil spring includes a wound portion which is wound around the rotating shaft and a cylindrical outer circumferential surface, the coil spring further includes two end portions extending inward in a radial direction from two ends of the wound portion and supported by the rotating shaft, and wherein, when the wound portion comes in contact with the second surface of the cutting target, the two end portions of the coil spring elastically deform and displace the wound portion in a direction away from the driving roller;

wherein the wound portion is separated from the driving roller by a gap smaller than a thickness of the cutting target when the coil spring is in a neutral, unbiased state.

2. The system according to claim 1, wherein the coil spring is a tension coil spring, and wherein a gap is formed between the rotating shaft and the tension coil spring.

3. The system according to claim 2, wherein the two end portions of the tension coil spring are formed into shapes which gradually decrease inner diameters toward distal ends, and the distal ends are fixed to the rotating shaft.

* * * * *